US006129123A

United States Patent [19]

Ludwig et al.

[11] Patent Number: 6,129,123

[45] Date of Patent: Oct. 10, 2000

[54] METHOD FOR CORRECTING A WEFT FAULT ON WEAVING MACHINES, ESPECIALLY AIR-JET WEAVING MACHINES WITH AUTOMATIC SELVEDGE TUCKING DEVICES

[75] Inventors: Hubertus Ludwig, Lindau; Hans-Joachim Zeller, Braeunlingen; Adnan Wahhoud, Lindau-Bodolz, all of Germany

[73] Assignee: Lindauer Dornier Gesellschaft mbH, Lindau, Germany

[21] Appl. No.: 09/357,304

[22] Filed: Jul. 20, 1999

[30] Foreign Application Priority Data

Jul. 23, 1998 [DE] Germany ..... 198 33 079

[51] Int. Cl.[7] ..... D03D 47/30; D03D 47/48

[52] U.S. Cl. ..... 139/116.2; 139/434

[58] Field of Search ..... 139/116.2, 434

[56] References Cited

U.S. PATENT DOCUMENTS

| | | | |
|---|---|---|---|
| 5,005,609 | 4/1991 | Volland et al. | 139/116.2 |
| 5,333,651 | 8/1994 | Riezler | 139/435.5 |
| 5,649,570 | 7/1997 | Wahhoud et al. | 139/291 C |

FOREIGN PATENT DOCUMENTS

| | | |
|---|---|---|
| 0 291 744 | 11/1988 | European Pat. Off. . |
| 0 465 416 | 1/1992 | European Pat. Off. . |
| 689 02 359 | 3/1993 | Germany . |
| 44 43 899 | 11/1995 | Germany . |

*Primary Examiner*—Andy Falik
*Attorney, Agent, or Firm*—Evenson, McKeown, Edwards & Lenahan, P.L.L.C.

[57] ABSTRACT

A method and a machine to assist the automatic correction of a weft fault in the manufacture of fabric with pneumatically created insertion edges. During the automatic correction of a weft fault, at least one additional air blast from a nozzle drives the weft thread contrary to the weft thread beating-up movement of a reed.

15 Claims, 3 Drawing Sheets

METHOD FOR CORRECTING A WEFT FAULT ON WEAVING MACHINES, ESPECIALLY AIR-JET WEAVING MACHINES WITH AUTOMATIC SELVEDGE TUCKING DEVICES

BACKGROUND AND SUMMARY OF THE INVENTION

This application claims the priority of German patent 198 33 079, filed Jul. 23, 1998.

The invention relates to a method for correcting a weft fault on weaving machines, especially air-jet weaving machines with pneumatic selvedge tucking devices disposed at the entry and exit ends of a shed, wherein a weft thread is blown by a main nozzle into the weft thread input channel of a reed and is recognized and detected by a weft thread monitor as a weft fault present at the exit end of the reed, wherein the end of the weft thread is held by a suction nozzle disposed at the exit end of the weft thread monitor, according to which the cutting of the weft thread between the main jet nozzle and the selvedge tucking device at the entry end is prevented, wherein the weft thread is beaten by the reed against the edge of a fabric and bound in by warp threads, wherein the previously performed tying in of the weft thread is undone, according to which the weft thread is released from the edge of the fabric with formation of a weft thread loop and drawn out of the shed by the suction of the suction nozzle.

The invention further relates to a weaving machine with at least two head frames forming a shed, with a main jet nozzle, with a plurality of relay jets, with a reed beating the weft threads against the edge of a fabric, with a weft thread injection channel, with at least one weft thread monitor present at the exit end of the weft thread injection channel, with a stationary suction nozzle disposed at the exit end of the weft thread monitor, with a pneumatic selvedge tucking device at the entry end and with a pneumatic selvedge tucking device at the exit end, and with an entry-end and an exit-end weft thread shear.

Weaving machines, especially air-jet weaving machines, are known, which are equipped with purely air-driven selvedge tucking devices for the formation of tight, closed fabric edges.

One selvedge tucking device is positioned on the entry side and one on the exit side of a shed to be formed and close to the outside edge of a fabric in the weaving machine, such that the weft thread injected into the shed, when it is beaten to the leading edge of the fabric by a reed, arrives simultaneously over the approximately V-shaped weft thread inlet of the selvedge tucking device into an end-limited centering slot of the selvedge tucking device lying approximately in the plane of the leading edge of the fabric.

After a weft thread correctly placed into the shed has been beaten onto the edge it is cut by weft thread shears disposed as is known in the particular selvedge tucking device and then the weft thread ends are pneumatically returned into the shed which as a rule follows the shed whose weft threads have bound off the previously injected weft threads.

If in the course of the weft thread insertion process a fault of any kind has been found and detected by control devices during the process of inserting the weft threads, a procedure known in itself is automatically started for remedying this error usually present in the weft thread. This procedure is known to those skilled in the art as "automatic weft break correction."

The procedure of automatic weft break correction assumes, among other things in air-jet weaving machines, that downstream and at the outlet end of the weft thread injection channel of a reed, means are present for seizing and pulling out the weft thread in question; that the weft thread involved, which has been beaten to the edge of the fabric is not being cut by the weft thread shears, and that so-called relay jets are present across the width of the weave which release the weft thread from the fabric edge with the formation of a so-called weft thread loop while the shed is open.

Together with this releasing action, the means for pulling out the weft thread is active, so that a programmed weft thread length can be drawn out to remove the weft fault from the pulling means, which is usually a pneumatically acting suction nozzle.

On account of the different geometrical circumstances necessarily present in an air-jet weaving machine, the position of the stationary air selvedge tucking device and the position of the fixedly arranged suction nozzle, the weft thread to be released from the cloth edge is pulled at an angle through the centering slot of the selvedge tucking device. In the case of looping the weft thread, the result of this is that the loop catches on the weft thread side of the centering slot, that is, it cannot be pulled away without the danger that the weft thread will hang up at the centering slot or break off.

The invention is addressed to the problem of finding measures to assist the automatic correction of a weft fault when fabrics are made with pneumatically produced edges.

The problem is solved according to the invention by adding a process step to the known procedure of automatic weft fault correction, which consists in the fact that at least one air pulse is applied to the weft thread to be released from the leading edge of the cloth, such that the loop in the weft thread lies outside of the centering slot of the selvedge tucking device when the weft thread is pulled out or at least it leaves the centering slot.

For the performance of the additional process step, an air-jet nozzle is provided according to the invention, whose outlet is aimed at a section of weft thread which is on the outlet side of the shed and which is preferably aimed at the weft thread in the centering slot of the selvedge tucking device.

It is an advantage when the air is tangent at least on the warp side of the centering slot of the selvedge tucking device and therefore strikes the weft thread inside of the centering slot. This means that the air jet issues from the nozzle at an acute angle to the longitudinal central axis of the selvedge tucking device.

In an embodiment of the invention provision is made such that the centering slot of the selvedge tucking device has over a certain length L on the warp thread side a target surface formed in the direction of the upper warp threads and one formed in the direction of the lower warp threads in order to achieve a sufficiently great effectiveness of the air blast in the centering slot and to assist the slipping of the weft thread out of the centering slot.

It is contemplated to provide another air nozzle alongside the first air nozzle present according to the invention, i.e., to provide it downstream from the centering slot, in order to assist the effectiveness of the looping of the weft thread out of the centering.

According to the invention, an additional flow channel can be present in the selvedge tucking device on the exit side, the outlet of which is aimed at the weft thread.

According to the invention it can furthermore be provided that the selvedge tucking device is positively steered out of the critical area of the weft thread movement or is swung by the pulling weft thread itself out of its working position and swung back to its working position after the end of the weft fault correction.

With the solution according to the invention, the automatic elimination of weft faults in the production of fabrics with insertion edges produced by pneumatic selvedge tucking devices can be executed without interrupting the progress of the work.

Manual intervention in the system by the operator is avoided and stoppage of the weaving machine resulting therefrom with its consequences, such as start-stop marks in the fabric, are reduced.

The solution according to the invention thus contributes to increasing the effectiveness of an air-jet weaving machine with pneumatic selvedge tucking devices.

Other objects, advantages and novel features of the present invention will become apparent from the following detailed description of the invention when considered in conjunction with the accompanying drawings.

DETAILED DESCRIPTION OF THE DRAWINGS

Figure 1:
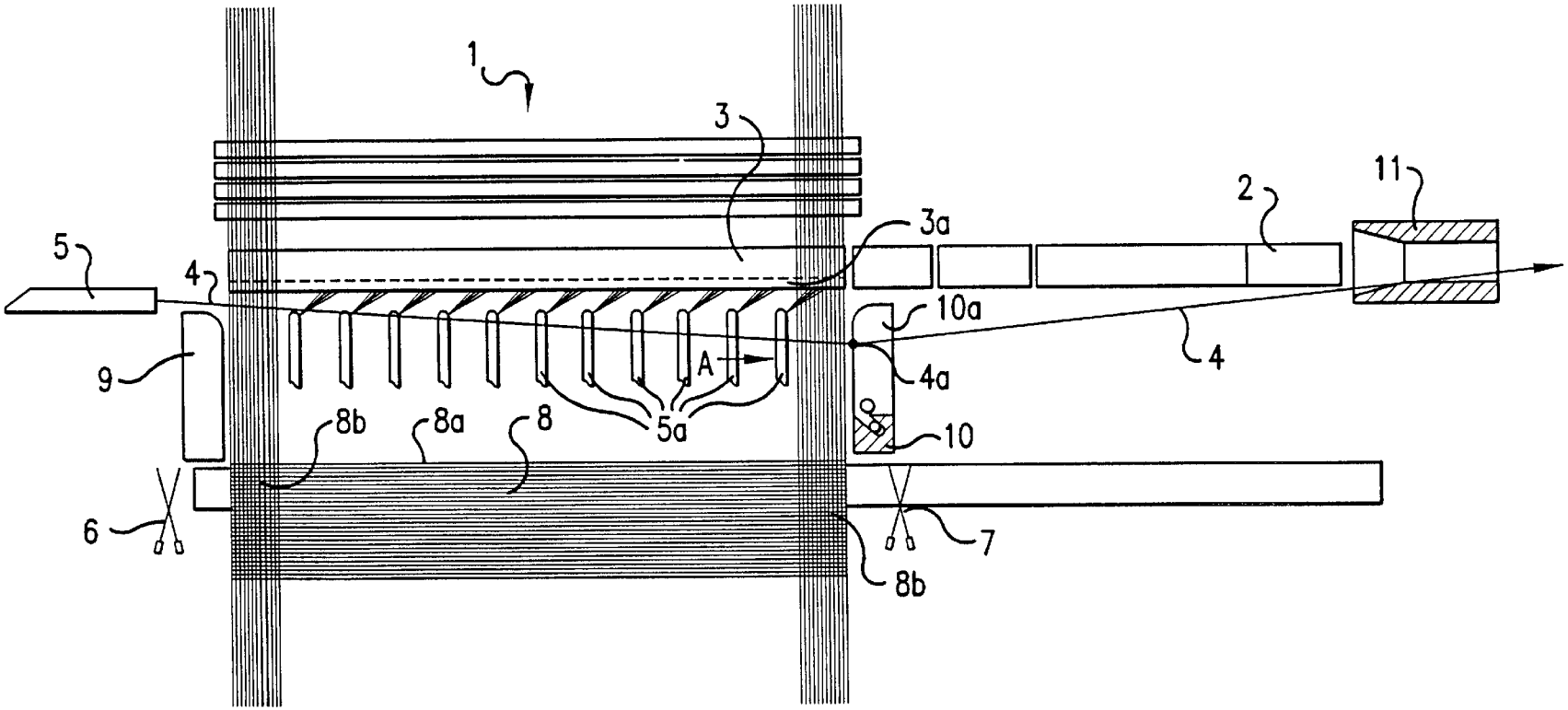
FIG. 1 PRIOR ART
FIG. 1 shows a known method of weft fault correction on an air-jet weaving machine with pneumatic selvedge tucking devices according to the prior art.

In the prior art, in the schematically represented air-jet weaving machine 1 of FIG. 1, the correction of a weft fault is performed in that first a weft thread monitor 2 at the exit end of the weft insertion channel 3*a* of a reed 3 detects an error in the weft thread entering from the main jet nozzle 5 into the insertion channel 3*a*. The weft thread 4 passing by the weft thread monitor 2 is thereupon seized by a stationary suction nozzle 11 and held taut.

The detection signal of the weft thread monitor 2 is used in the control system to stop the cutting operation of the weft thread shear 6 at the point of entry and the weft thread shear 7 at the point of exit.

The weft thread 4 leading to a weft fault and entering the channel 3*a* in the reed 3 is beaten up by the reed 3 against the edge 8*a* of the fabric 8, although the drive of the slay bearing the reed is also shut off. The beating up of the weft thread is due to the fact that moments of inertia are active in the drive of the weaving machine and in the slay itself and thus a stroke of the reed against the edge 8*a* cannot be prevented by a stop signal from the weft thread monitor 2.

The weft thread 4 in question is therefore necessarily beaten up to the edge 8*a* of the fabric 8 after a stop signal from the weft thread monitor 2. By a process known to those skilled in the art by the term, "automatic weft thread break elimination," a procedure is started for the purpose of releasing from the edge 8*a* of the fabric the weft thread 4 that has been beaten up against it.

The steps of the procedure up to the resumption of the weaving process are known, so they will not be discussed in detail at this point.

In case a fabric 8 is to be produced with so-called insertion edges 8*b*, and these insertion edges 8*b* are made by pneumatic selvedge tucking devices 9 and 10, the difficulty represented in FIG. 1 arises, that the loop 4*a* forming after the weft thread 4 is released from the edge 8*a* cannot pass through the weft thread entrance 10*a* of the centering slot 10*b* of the selvedge tucking device on the exit end, and withdrawal of the weft thread by the suction nozzle 11 is prevented and thus the automatic weft thread break elimination is blocked.

Here the solution offered by the invention comes in.

Figure 2:
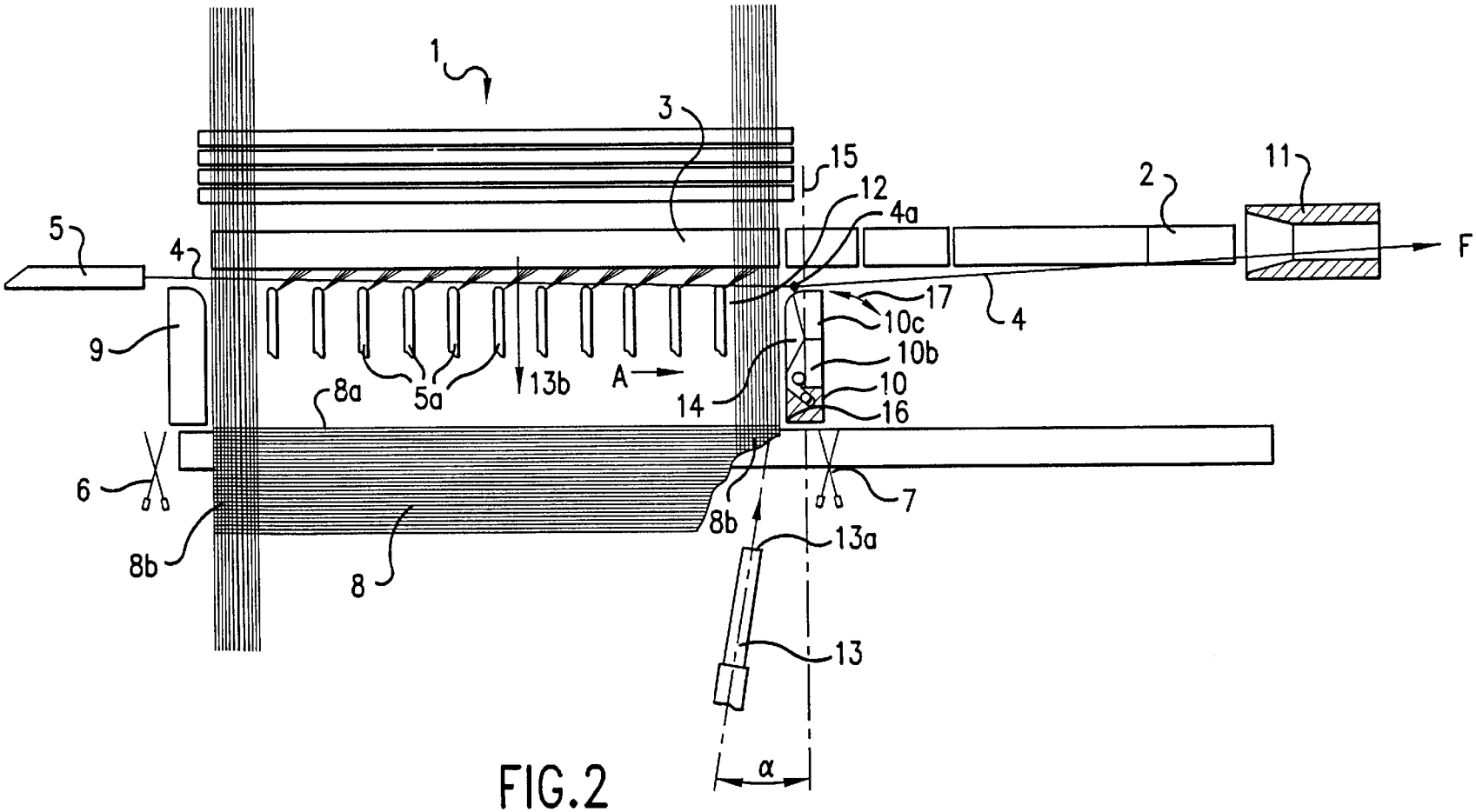
FIG. 2 shows a method of weft fault correction according to a preferred embodiment of the present invention.

According to FIG. 2, during the automatic weft thread break elimination, at least one air blast from the nozzle 13 at the exit end of the shed 12 strikes the weft thread 4 at an angle $\alpha$ contrary to the beating-up motion 3*b* of the reed 3 such that, during the weft thread break elimination, a weft thread defect in the form of a loop 4*a* is not in contact with the selvedge tucking device 10, or at least is blown out of the selvedge tucking device 10.

It is advantageous if the air blast is aimed at an acute angle $\alpha$ at the opening of the weft thread entry 10*a* and of the centering slot 10*b* of the selvedge tucking device 10 on the warp thread end, because in connection with a configuration according to the invention of the opening of the weft thread entry 10*a* and of the centering slot 10*b* the action of the air blast on the weft thread 4 is assisted thereby.

The further solution according to the invention consists in the fact that the warp-end weft thread entry 10*a* and the centering slot 10*b* form over a predetermined length L a surface 14 to be struck by the at least one air blast.

If in a further advantageous embodiment of the invention the selvedge tucking device 10 is additionally mounted for rotation or at least for pivoting about an axis 16 off-center from the longitudinal central axis 15 of the selvedge tucking device, the at least one air blast acting on the surface 14 results in a swinging of the selvedge tucking device in the direction of the double arrow 17.

Under some circumstances the swinging movement can be assisted in combination with the traction force F of the suction nozzle 11. This of course assumes that the weft thread 4 is caught by the suction nozzle 11 and a weft thread loop 4*a* actually does come in contact with the selvedge tucking device 10 at the exit end.

Figure 3:
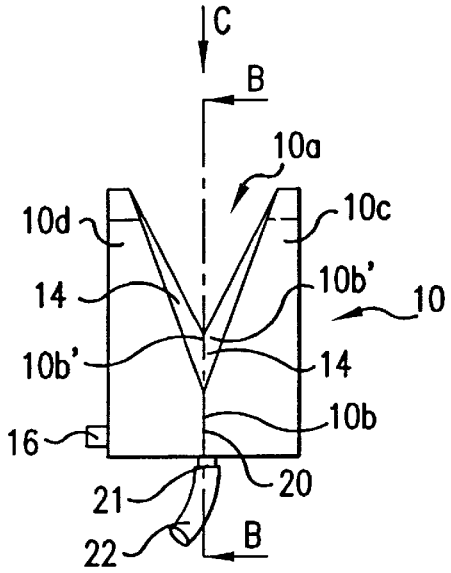
FIG. 3 is a schematic plan view of a pneumatic selvedge tucking device according to view A in FIGS. 2 and 4.
Figure 4:
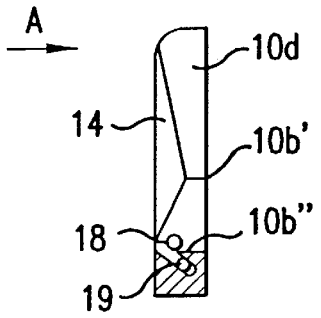
FIG. 4 is a schematic view of the pneumatic selvedge tucking device according to line B—B in FIG. 3, as also shown in FIG. 2.

FIG. 3 shows the pneumatic selvedge tucking device according to view A in FIGS. 2 and 4, as it is used in a schematically represented air jet weaving machine according to FIG. 2.

The selvedge tucking device 10 has a V-shaped weft thread entryway 10*a* which merges with the end-limited centering slot 10*b* in which the end of the weft thread 4 is held and finally is returned into a shed 12 according to FIG. 2.

The weft thread entrance 10*a* and the centering slot 10*b* form each, according to the invention, between the upper and lower guiding branches 10*c* and 10*d*, a surface 14 at which the outlet 13*a* of a nozzle 13 can be aimed, see FIG. 2. The lower and upper surfaces 14 of the selvedge tucking device 10 essential for the ejection of the weft thread 4 extend on the warp thread side approximately from the upper and lower edge of the selvedge tucking device branches 10*c* and 10*d* of the V-shaped weft thread entrance 10*a* to the upper and lower edges of the centering slot 10*b*.

According to FIG. 3, as an alternative to the air jet nozzle 13 of FIG. 2, and in a further embodiment of the invention, a weft thread blow-out nozzle 20 with a compressed air connection 21 acting in the direction of the weft thread inlet 10*a* can be provided at the end 10*b*" of the centering slot 10*b*. The compressed air connection 21 is connected to a flexible compressed air line 22.

FIG. 4 shows the exit end selvedge tucking device 10 as seen in the direction B—B in FIG. 3. The edges 10*b*' of the lower branch 10*d* and upper branch 10*c* indicate the beginning of the centering slot 10*b* in FIG. 3.

For the purpose of gripping the end of a correctly entering weft thread 4 beaten up against the edge 8*a* of the fabric, a weft thread gripping channel 18 is provided, in a known manner, in which the exit end of the beaten-up weft thread 4 is held pneumatically. As it is known, for the purpose of inserting the exit end of a weft thread into a shed 12 a weft thread insertion channel 19 is present, which blows the thread held in the weft thread stretching channel 18 into the shed 12.

In order to enable the selvedge tucking device 10 to swivel in conjunction with the action of the air jet 13 during the elimination of the loop 4*a* in the weft thread, the selvedge tucking device 10 has a shaft 16 which is journaled in a part of the weaving machine that is not represented.

Figure 5:
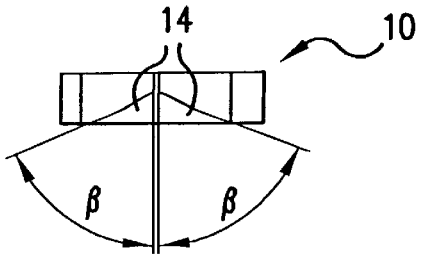
FIG. 5 is a schematic view of the pneumatic selvedge tucking device according to view C in FIG. 3.

The surfaces 14 formed on the selvedge tucking device 10 in FIG. 5 are each set at an angle β of more than 45°.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Method for correcting a weft fault on an air-jet weaving machine having a pneumatic selvedge tucking device disposed at entry and exit ends of a shed, comprising:

blowing a weft thread by a main nozzle into a weft thread input channel of a reed and using a weft thread monitor to detect the weft thread as a weft fault present at an exit end of the reed, holding an end of the weft thread by a suction nozzle disposed at the exit end of the weft thread monitor, preventing cutting of the weft thread between the main jet nozzle and the selvedge tucking device at the entry end, beating the weft thread by the reed against the edge of a fabric and binding in the same in by warp threads, undoing a previously performed tying in of the weft thread, releasing the weft thread from the edge of the fabric with formation of a weft thread loop and drawing the same out of the shed by the suction of the suction nozzle, and providing at least one additional air blast to drive the weft thread approximately against the weft thread beating movement of the reed during or after the release of the weft thread from the edge of the fabric.

2. Method according to claim 1, wherein the providing at least one additional air blast includes aiming the at least one air blast at the opening of the weft thread entry on the shed side and into the selvedge tucking device.

3. Method according to claim 1, wherein the providing the at least one air blast causes the exit-end selvedge tucking device to turn out of a usual working position.

4. Method according to claim 1, wherein the providing the at least one air blast causes the selvedge tucking device at the exit end to turn out of a usual working position together with a loop present in the tension-loaded weft thread and in contact with the selvedge tucking device.

5. An air-jet weaving machine, comprising:

at least two heald frames forming a shed;

a main jet nozzle;

a plurality of relay jets;

a reed to beat weft threads against an edge of a fabric;

a weft thread insertion channel;

at least one weft thread monitor present at an exit end of the weft thread insertion channel;

a stationary suction nozzle disposed at an exit end of the weft thread monitor;

an entry-end pneumatic selvedge tucking device proximate an entry end of the shed;

an exit-end pneumatic selvedge tucking device proximate an exit end of the shed;

an entry-end weft thread shear;

an exit-end weft thread shear; and an air jet nozzle having a discharge end aimed at a section of the weft thread lying between the exit end of the shed and an opening of the exit-end pneumatic selvedge tucking device on the shed side for discharging at least one air blast against the section of the weft thread.

6. Weaving machine according to claim 5, wherein the air blast is produced by way of an additional flow channel in the exit-end pneumatic selvedge tucking device.

7. Weaving machine according to claim 5, wherein the discharge end of the air jet is aimed at an acute angle α to a longitudinal central axis of the exit-end pneumatic selvedge tucking device.

8. Weaving machine according to claim 5, wherein the exit-end pneumatic selvedge tucking device has a pair of guiding arms, said guiding arms having respective guide surfaces on a side facing the shed.

9. Weaving machine according to claim 8, wherein the guide surfaces are aligned at an angle β greater than 45° to a longitudinal central axis of the exit-end pneumatic selvedge tucking device.

10. Weaving machine according to claim 5, comprising means for pivoting the exit-end pneumatic selvedge tucking device about a pivot point at a distance from a longitudinal central axis of the exit-end pneumatic selvedge tucking device.

11. Weaving machine according to claim 6, further comprising a weft thread stretching channel and a weft thread insertion channel, said flow channel being disposed along a longitudinal central axis of the exit-end pneumatic selvedge tucking device.

12. Method for correcting a weft fault in an air-jet weaving machine having a reed which beats weft threads against an edge of a fabric, and having a pneumatic selvedge tucking device disposed at an exit end of a shed, wherein when a weft fault is detected a faulty weft thread is released from the edge of the fabric and is drawn out of the shed by a suction nozzle, said method comprising:

during or after the release of the weft thread from the edge of the fabric, discharging at least one additional air blast against the faulty weft thread in a direction approximately against the weft thread beating movement of the reed.

13. Method according to claim 12, wherein said discharging an air blast is performed using an additional flow channel in the pneumatic selvedge tucking device.

14. Method according to claim 12, wherein said discharging an air blast is performed using an air jet nozzle aimed at an acute angle $\alpha$ to a longitudinal control central axis of the pneumatic selvedge device.

15. An air-jet weaving machine, comprising:

a shed having an entry end and an exit end;

a reed to beat weft threads against an edge of a fabric;

at least one weft thread monitor which detects a weft fault;

a suction nozzle which removes a faulty weft thread;

a pneumatic selvedge tucking device proximate the exit end of the shed; and an air jet nozzle having a discharge end aimed toward the pneumatic selvedge tucking device in a direction approximately against the weft thread beating movement of the reed.

* * * * *